US009874847B2

(12) United States Patent
Yamaguchi et al.

(10) Patent No.: US 9,874,847 B2
(45) Date of Patent: Jan. 23, 2018

(54) CLEANING UNIT AND IMAGE FORMING APPARATUS

(71) Applicant: FUJI XEROX CO., LTD., Tokyo (JP)

(72) Inventors: Mikio Yamaguchi, Yokohama (JP); Hiroyuki Mamiya, Yokohama (JP); Yosuke Ninomiya, Yokohama (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/248,494

(22) Filed: Aug. 26, 2016

(65) Prior Publication Data

US 2017/0269537 A1 Sep. 21, 2017

(30) Foreign Application Priority Data

Mar. 15, 2016 (JP) ..... 2016-050464

(51) Int. Cl.
*G03G 21/00* (2006.01)
*G03G 15/095* (2006.01)

(52) U.S. Cl.
CPC ..... *G03G 21/0011* (2013.01); *G03G 15/095* (2013.01); *G03G 2221/0005* (2013.01)

(58) Field of Classification Search
None
See application file for complete search history.

(56) References Cited

U.S. PATENT DOCUMENTS

2004/0258441 A1* 12/2004 Park ..... G03G 21/105 399/350
2006/0216083 A1* 9/2006 Okoshi ..... G03G 21/105 399/350
2014/0212193 A1* 7/2014 Goda ..... G03G 21/0029 399/350

FOREIGN PATENT DOCUMENTS

JP 07325521 A * 12/1995
JP 10301460 A * 11/1998
JP 2009-145661 A 7/2009
JP 2011-149981 A 8/2011

OTHER PUBLICATIONS

JP 10301460 A English machine translation, Oike et al., Nov. 13, 1998.*

* cited by examiner

*Primary Examiner* — David M Gray
*Assistant Examiner* — Thomas Giampaolo, II
(74) *Attorney, Agent, or Firm* — Oliff PLC

(57) ABSTRACT

A cleaning unit includes a cleaning member that removes a developer from a surface of an image holding member; an accommodating portion that accommodates the removed developer; and a transport member that transports the developer removed by the cleaning member to the accommodating portion, wherein the transport member includes a transport unit that extends in a direction intersecting with a developer transport direction, has a surface formed to be inclined in a direction approaching the cleaning member towards an upstream side, and transports the developer while contacting with the developer.

3 Claims, 7 Drawing Sheets

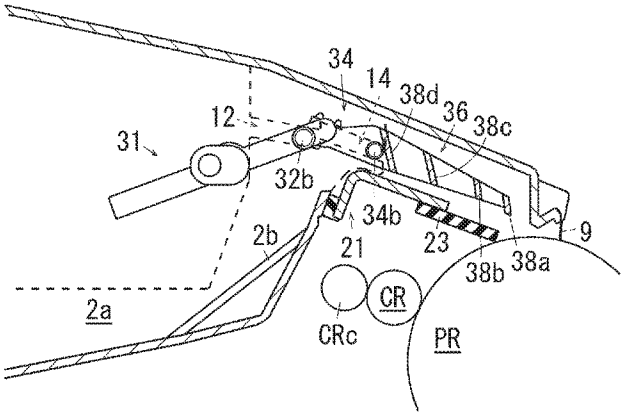
FIG. 5A
FIG. 5B
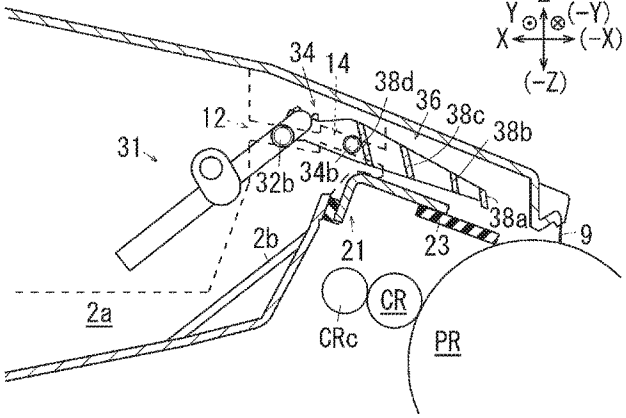
FIG. 5C
FIG. 5D

CLEANING UNIT AND IMAGE FORMING APPARATUS

CROSS-REFERENCE TO RELATED APPLICATIONS

This application is based on and claims priority under 35 USC 119 from Japanese Patent Application No. 2016-050464 filed Mar. 15, 2016.

BACKGROUND

Technical Field

The present invention relates to a cleaning unit and an image forming apparatus.

SUMMARY

According to an aspect of the invention, there is provided a cleaning unit including: a cleaning member that removes a developer from a surface of an image holding member; an accommodating portion that accommodates the removed developer; and a transport member that transports the developer removed by the cleaning member to the accommodating portion, wherein the transport member includes a transport unit that extends in a direction intersecting with a developer transport direction, has a surface formed to be inclined in a direction approaching the cleaning member towards an upstream side, and transports the developer while contacting with the developer.

BRIEF DESCRIPTION OF THE DRAWINGS

Exemplary embodiments of the present invention will be described in detail based on the following figures, wherein:

FIGS. 5A to 5D are views for describing an operation of the transport member of exemplary embodiment 1, in which FIG. 5A is a view for describing a state that is the same as FIG. 2, FIG. 5B is view for describing a state in which the transport member is rotated about the rotating shaft by 30° from the state of FIG. 5A, FIG. 5C is a view for describing a state in which the transport member is rotated about the rotating shaft by 30° from the state of FIG. 5B, and FIG. 5D is a view for describing a state in which the transport member is rotated about the rotating shaft by 30° from the state of FIG. 5C;

FIGS. 6A to 6D are views for describing an operation of the transport member of exemplary embodiment 1, in which FIG. 6A is a view for describing a state in which the transport member is rotated about the rotating shaft by 30° from the state of FIG. 5D, FIG. 6B is a view for describing a state in which the transport member is rotated about the rotating shaft by 30° from the state of FIG. 6A, FIG. 6C is a view for describing a state where the transport member is rotated about the rotating shaft by 30° from the state of FIG. 6B, and FIG. 6D is a view for describing a state in which the transport member is rotated about the rotating shaft by 30° from the state of FIG. 6C; and FIGS. 7A to 7D are views for describing an operation of the transport member of exemplary embodiment 1, in which FIG. 7A is a view for describing a state in which the transport member is rotated about the rotating shaft by 30° from the state of FIG. 6D, FIG. 7B is a view for describing a state in which the transport member is rotated about the rotating shaft by 30° from the state of FIG. 7A, FIG. 7C is a view for describing a state in which the transport member is rotated about the rotating shaft by 30° from the state of FIG. 7B, and FIG. 7D is a view for describing a state in which the transport member is rotated about the rotating shaft by 30° from the state of FIG. 7C.

DETAILED DESCRIPTION

Figure 1:
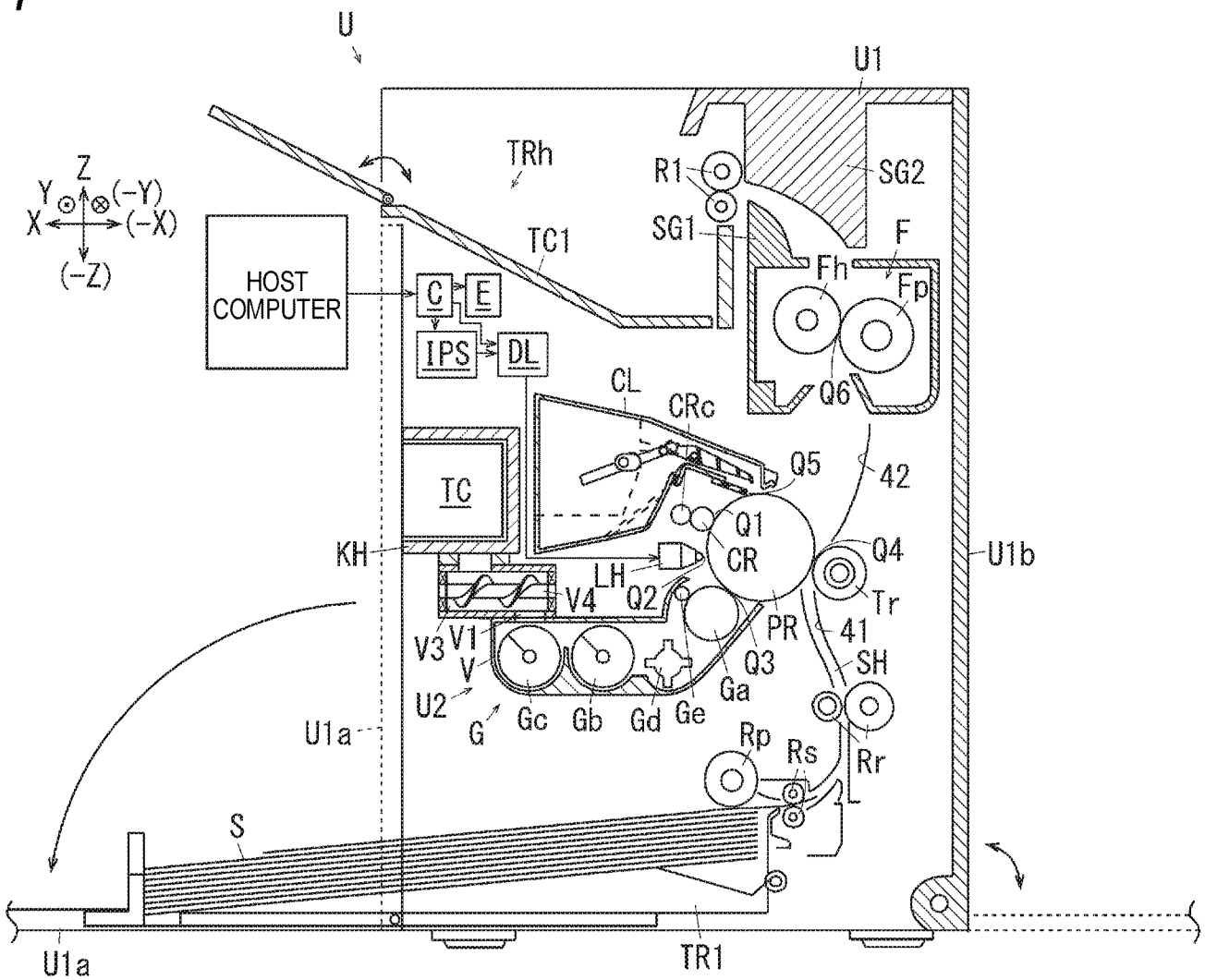
FIG. 1 is an explanatory view illustrating an overall image forming apparatus of exemplary embodiment 1.

Hereinafter, exemplary embodiments as specific examples of the present invention will be described in detail, but the invention is not limited to the following exemplary embodiments.

In order to facilitate understanding of the following description, a front-rear direction, a left-right direction, and an up-down direction in the drawings will be referred to as an X-axis direction, a Y-axis direction, and a Z-axis direction, respectively, and directions or sides indicated by arrows X, −X, Y, −Y, Z, and −Z will be referred to as front, rear, right, left, top, and bottom, respectively, or referred to as front side, and rear side, right side, left side, top side, and bottom side, respectively.

Further, in the drawings, when "·" is indicated within "○," it means an arrow directed from the back to the front of a sheet, and when "×" is indicated within "○," it means an arrow directed from the front to the back of the sheet.

In addition, illustration of members other than members that are necessary for the description in order to facilitate understanding are appropriately omitted in the following description which will be made with reference to the accompanying drawings.

Exemplary Embodiment 1

FIG. 1 is an explanatory diagram illustrating an overall image forming apparatus of exemplary embodiment 1.

In FIG. 1, a printer U as an example of the image forming apparatus of exemplary embodiment 1 of the present invention includes a front cover U1*a* as an example of an open/close member is supported on the front surface of a printer body U1 as an example of an image forming apparatus body. The front cover U1*a* is supported to be capable of being opened/closed about a lower end thereof. In the case of inserting or accommodating a recording sheet S as an example of a medium, the front cover U1*a* may open/close the front surface of the printer body U1.

Further, an exit tray TRh as an example of a discharge part is formed on the top surface of the printer U. A rear cover U1*b* as an example of the open/close member is rotatably supported on the rear surface of the printer body U1. The rear cover U1*b* is supported to be rotatable between a close position illustrated by the solid line and an opened position illustrated by the dashed line. In a case of conducting, for example, inspection of a paper jam or an internal state, the rear cover U1*b* as an example of the open/close member may open the rear surface of the printer body U1.

The printer U of exemplary embodiment 1 has a controller C as an example of a control unit. An image processing unit IPS, a laser driving circuit DL as an example of a latent image forming circuit, or a power circuit E is electrically connected to the controller C. Therefore, the controller C may output a control signal to the image processing unit IPS or the like.

A rotationally driven photoreceptor PR as an example of an image holding member is supported in the rear portion of the printer U. Around the photoreceptor PR as an example of a rotating member, a charging roll CR, a latent image forming device LH, a developing device G, a transfer roll Tr as an example of a transfer member, and a photoreceptor cleaner CL as an example of a cleaning unit for an image holding member are arranged along the rotating direction of the photoreceptor PR.

In FIG. 1, a charging roll cleaner CRc as an example of a cleaning unit for the charging unit is disposed to contact with the charging roll CR while being opposed to each other.

The latent image forming device LH of exemplary embodiment 1 is constituted with a device in which LEDs (Light Emitting Diodes) as an example of a latent image recording element are linearly arranged at preset intervals in the left-right direction, a so-called LED head.

The developing device G has a developing container V in which a developer is accommodated. A developing roll Ga as an example of a developer holding member is disposed in the developing container V to face the photoreceptor PR. A pair of circulating and transport members Gb and Gc and a supply member Gd are arranged in the developing container V in the remote order from the developing roll Ga. Further, in the developing container V, a layer thickness regulation member Ge is disposed to face the developing roll Ga.

A developer replenishing port V1 as an example of a replenishing part is formed in the top surface of the front side of the developing container V. A developer replenishing path V3 as an example of a developer transport path is connected to the developer replenishing port V1. The developer replenishing path V3 is formed in a shape of a cylinder that extends forward. A replenishing auger V4 as an example of a developer transport member is rotatably supported in the developer replenishing path V3. A cartridge holder KH as an example of a detachable unit is connected to a front end of the developer replenishing path V3. A toner cartridge TC as an example of a developer accommodating container is detachably supported on the cartridge holder KH. An inlet port (not shown) is formed in the cartridge holder KH, and configured such that the developer may flow into the inlet port from the toner cartridge TC.

In FIG. 1, a sheet feeding tray TR1 as an example of a medium accommodating part is disposed in a lower portion of the printer U. A pickup roll Rp as an example of a medium extraction member is disposed in the rear portion of the sheet feeding tray TR1. A retard roll Rs as an example of a medium separating member is disposed behind the pickup roll Rp. A registration roll Rr as an example of a timing member is disposed above the retard roll Rs.

A fixing device F is disposed above a transfer region Q4 in which the photoreceptor PR faces the transfer roll Tr. The fixing device F has a pair of fixing rolls Fh and Fp as an example of a fixing member, and a fixing region Q6 is formed by a region in which the pair of fixing rolls Fh and Fp is pressed to contact with each other.

Sheet guides SG1 and SG2 as an example of a medium guide member are disposed above the fixing device F. An exit roll R1 as an example of a discharge member is disposed in front of the sheet guides SG1 and SG2.

(Description of Image Forming Operation)

Printing information is transmitted from a host computer or the like, as an example of an external information transmitting device, to the controller C of the printer U. When the controller C receives the printing information, the image forming operation is initiated. The controller C outputs the printing information to the image processing unit IPS. The image processing unit IPS converts the printing information into image information for forming a latent image, and outputs the image information to the laser driving circuit DL as an example of an image recording circuit at a preset time, namely, timing. The laser driving circuit DL outputs a driving signal to the latent image forming device LH in response to the inputted image information.

When the image forming operation is initiated, the photoreceptor PR starts rotating.

A charging voltage is applied to the charging roll CR from the power circuit E. In a charging region Q1 in which the charging roll CR faces the photoreceptor PR, the charging roll CR charges the surface of the photoreceptor PR. The charging roll cleaner CRc cleans the surface of the charging roll CR.

The latent image forming device LH forms an electrostatic latent image, which corresponds to the image information, on the surface of the photoreceptor PR in a recording region Q2.

In the developing device G, the pair of circulating and transport members Gb and Gc circulate and transport the developer in the developing container V while agitating the developer in the developing container V. The supply member Gd transports the developer agitated in the circulating and transport members Gb and Gc to the developing roll Ga. A layer thickness of the developer on the surface of the developing roll Ga is regulated when the developer passes through the region facing the layer thickness regulation member Ge. A developing voltage is applied to the developing roll Ga from the power circuit E. In a developing region Q3 where the developing roll Ga faces the photoreceptor PR, the electrostatic latent image of the photoreceptor PR is developed to a visible image by the developer of the developing roll Ga.

Depending on the consumption of the developer in the developing device G, the replenishment auger V4 is driven so that the toner cartridge TC replenishes the developing device G with the developer.

The pickup roll Rp delivers a recording sheet S accommodated in the sheet feeding tray TR1.

When the pickup roll Rp delivers multiple recording sheets S, the retard roll Rs separates the sheets one by one. The recording sheets S that have been separated one by one by the retard roll Rs are sent to the registration roll Rr. The registration roll Rr transports the recording sheets S to the transfer region Q4 at a preset timing.

A transfer voltage is applied to the transfer roll Tr from the power circuit E. The transfer roll Tr transfers a toner image on the photoreceptor PR to the recording sheet S that passes through the transfer region Q4.

The photoreceptor cleaner CL removes residual toner from the surface of the photoreceptor PR in a cleaning region Q5 as an example of a cleaning region that is set at a downstream side of the transfer region Q4.

The recording sheet S to which the toner image is transferred in the transfer region Q4 is transported to the fixing device F with the toner image not being fixed.

The fixing region Q6 is formed in the fixing device F by a region where the fixing rolls Fh and Fp are pressed to contact with each other. The toner image is fixed to the recording sheet S transported into the fixing device F by the pair of fixing rolls Fh and Fp in the fixing region Q6.

The recording sheet S to which the toner image is fixed is guided by the sheet guides SG1 and SG2.

The exit roll R1 discharges the recording sheet S to the exit tray TRh.

(Description of Photoreceptor Cleaner CL)

Figure 2:
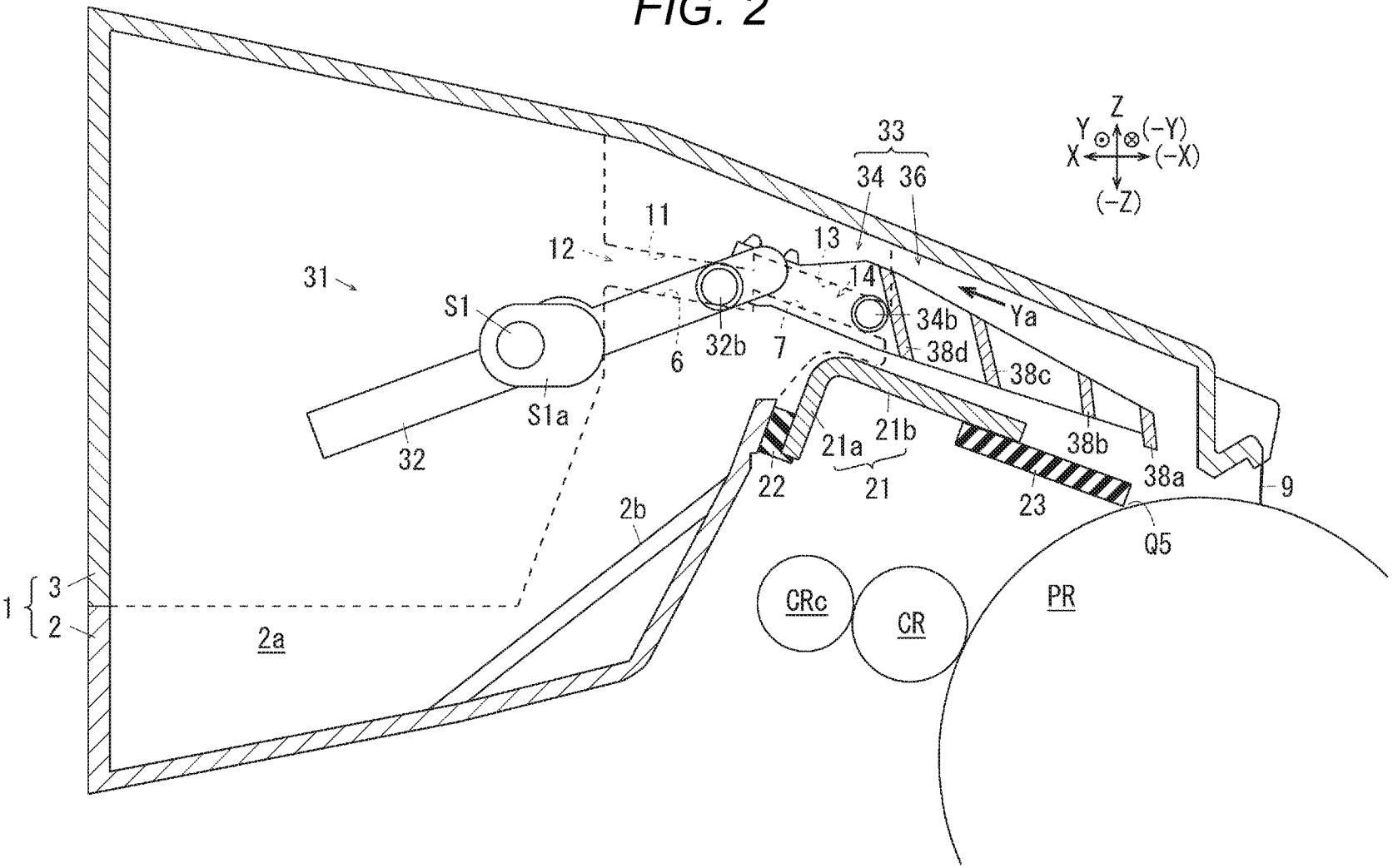
FIG. 2 is an enlarged view of a main part of a photoreceptor cleaner of exemplary embodiment 1.

FIG. 2 is an enlarged view illustrating a main part of the photoreceptor cleaner of exemplary embodiment 1.

Figure 3:
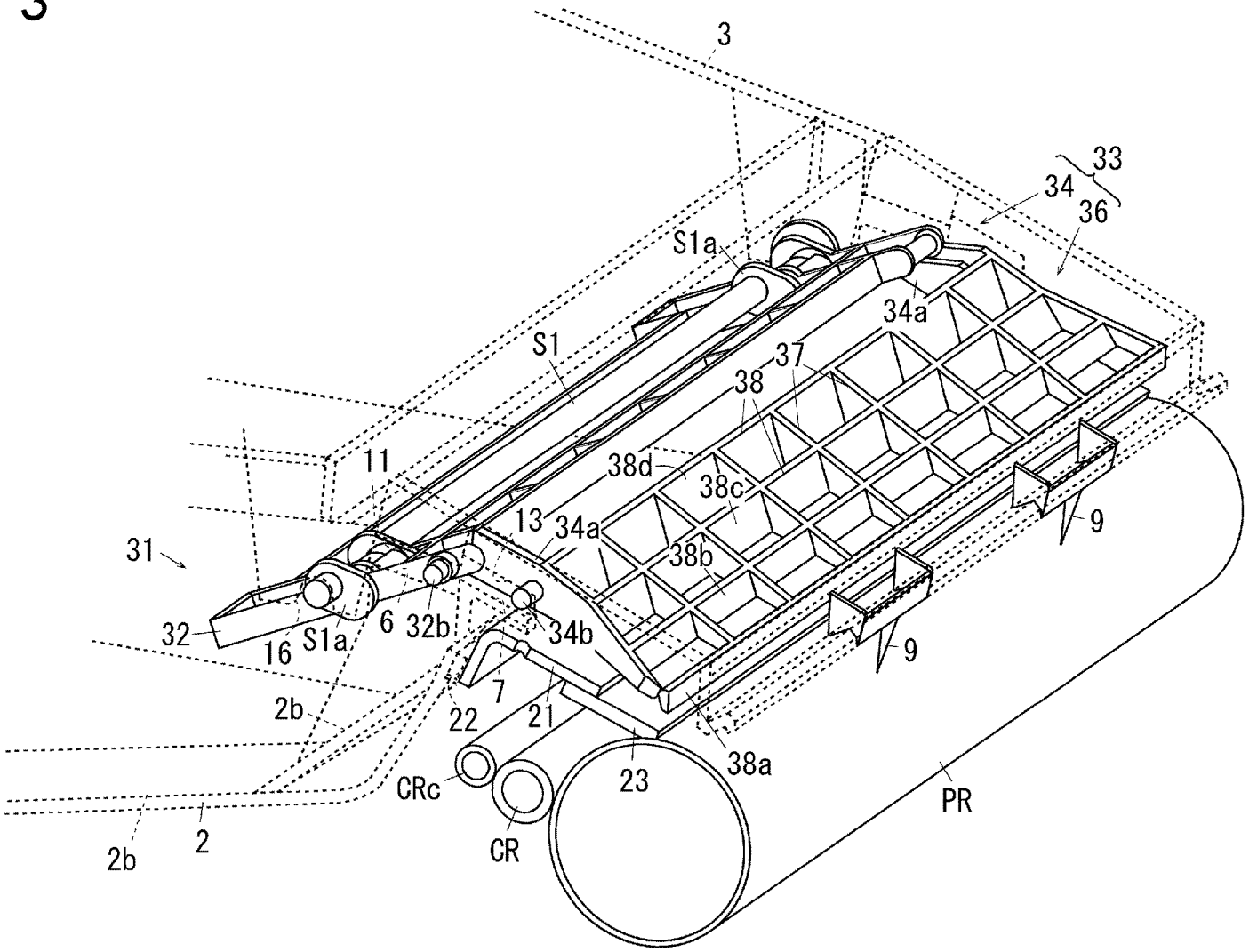
FIG. 3 is a perspective view of the main part of the photoreceptor cleaner of exemplary embodiment 1.

FIG. 3 is a perspective view illustrating the main part of the photoreceptor cleaner of exemplary embodiment 1.

In FIGS. 1 to 3, the photoreceptor cleaner CL of exemplary embodiment 1 includes a cleaner container 1 as an example of a cleaning container. In FIGS. 2 and 3, the cleaner container 1 has a container body 2 in a lower portion thereof, and a cover 3, as an example of a cover unit, in an upper portion thereof.

The container body 2 is formed in the shape of a box disposed in front of the charging roll CR. An accommodating portion 2*a* is formed in the container body 2. An inclined surface 2*b* upwardly inclined toward a rear side is formed in a rear portion of the accommodating portion 2*a*. First lower guide parts 6 are formed in the left and right ends of the container body 2 at a position corresponding to the upper side of the inclined surface 2*b*. The top surfaces of the first lower guide parts 6 are inclined downward toward the rear side. Second lower guide parts 7 are formed behind the first lower guide parts 6. The top surfaces of the second lower guide parts 7 are inclined downward toward the rear position. Further, the top surfaces of the second lower guide parts 7 are placed along a transport direction Ya of the recovered developer, and are formed such that an inclination angle thereof relative to a horizontal is larger than that of the upper surfaces of the first lower guide parts 6.

The cover 3 is formed in a shape of a cover that closes the top surface of the container body 2. The rear end of the cover 3 extends rearward beyond the cleaning region Q5. In FIG. 3, a peeling claw 9 as an example of a medium peeling member is supported on the rear end of the cover 3. Two peeling claws 9 are arranged to be spaced apart from each other in a widthwise direction of the recording sheet S.

First upper guide parts 11 are formed on the left and right ends of the cover 3 at positions facing the first lower guide parts 6. The bottom surfaces of the first upper guide parts 11 are formed to be parallel to the top surfaces of the first lower guide parts 6. A first guide groove 12 is formed by a space between the first lower guide parts 6 and the first upper guide parts 11.

Further, second upper guide parts 13 are formed on the left and right ends of the cover 3 at positions facing the second lower guide parts 7. The bottom surfaces of the second upper guide parts 13 are formed to be parallel to the top surfaces of the second lower guide parts 7. A second guide groove 14 is formed by a space between the second lower guide parts 7 and the second upper guide parts 13.

Further, bearings 16 are formed on the left and right ends of the cover 3 below the front side of the first lower guide parts 6.

In FIGS. 2 and 3, a blade holder 21 as an example of a supporting body is supported on an outer surface of an upper portion of the rear end of the container body 2. The blade holder 21 of exemplary embodiment 1 is supported on the container body 2 through a seal 22 as an example of a sealing member.

The blade holder 21 of exemplary embodiment 1 is formed by bending a sheet metal in an L shape. The blade holder 21 has a supported part 21*a* that is supported on the seal 22, and a holder body 21*b* that extends from the upper end of the supported part 21*a* toward the cleaning region Q5.

A cleaning blade 23 as an example of a cleaning member is supported on the bottom surface of the rear end of the holder body 21*b*. The cleaning blade 23 is has a leading end that contacts with the photoreceptor PR in the cleaning region Q5. The cleaning blade 23 of exemplary embodiment 1 is made of a rubber blade as an example of elastic material.

Thus, in exemplary embodiment 1, a space surrounded by the top surface of the holder body 21*b* or the cleaning blade 23 and the cover 3 forms a transport path in which the developer recovered in the cleaning region Q5 is transported.

In FIGS. 2 and 3, a transport member 31 is placed above the cleaning blade 23. The transport member 31 has a agitating unit 32 on a front side thereof, and a transport unit 33 on a rear side thereof.

The agitating unit 32 has a lattice structure obtained by combining plate-shaped members extending in a left-right direction and a front-rear direction. A rotating shaft S1 as an example of a transmitted part is disposed in a central portion of the agitating unit 32 in the front-rear direction. The rotating shaft S1 and the agitating unit 32 are connected to each other via connecting members S1*a*. The connecting members S1*a* extend in a diametric direction of the rotating shaft S1. That is, the rotation of the rotating shaft S1 is transmitted to the agitating unit 32 as with a crank shape.

Both the left and right ends of the rotating shaft S1 are rotatably supported by the bearings 16. The rotating shaft S1 is formed in a rod shape extending in the left-right direction. The left end of the rotating shaft S1 extends to the outside through the cleaner container 1, and driving is transmitted to the left end of the rotating shaft S1 from a motor (not shown) as an example of a driving source.

Further, first guide protrusions 32*b* as an example of a first guided part are formed on the rear end of the agitating unit 32. The first guide protrusions 32*b* are formed to protrude outward from the left and right ends of the agitating unit 32. The first guide protrusions 32*b* are supported to be fit for the first guide groove 12. Thus, the first guide protrusions 32*b* are supported to be movable along the first guide groove 12. Therefore, the agitating unit 32 is supported by the rotating shaft S1 and the first guide protrusion 32*b*, and is supported in the cleaner container 1 to be inclined downward toward the left side.

The front end of the transport unit 33 is rotatably supported on the rear end of the agitating unit 32. The transport unit 33 has a front downstream part 34 and a rear upstream part 36.

The downstream part 34 has a pair of left and right frames 34*a* on both the left and right ends thereof. Further, in the downstream part 34 of exemplary embodiment 1, no member is arranged inside the frames 34*a*. On the rear end of the downstream part 34, a position regulating protrusion 34*b* as an example of a second guide part is as an example of a regulating part. The position regulating protrusion 34*b* is supported to be movable along the second guide groove 14. Further, in exemplary embodiment 1, the moving range of the position regulating protrusion 34*b* in the developer transport direction is set up to a downstream side over a position of the supported part 21*a* of the blade holder 21.

Therefore, the transport unit 33 of exemplary embodiment 1 is supported in the cleaner container 1 by a portion connected with the agitating unit 32 and the position regulating protrusion 34*b*.

The upstream part 36 is formed in the shape of a lattice having vertical frames 37 as an example of a support part, and horizontal frames 38 as an example of a transport unit body. The vertical frames 37 are each formed in a plate shape extending in the front-rear direction, and the horizontal frames 38 are each formed in a plate shape extending in the left-right direction. Further, in exemplary embodiment 1, the bottom surface of the upstream part 36 is spaced apart from the top surface of the holder body 21*b* or the cleaning blade 23 such that the bottom surface of the upstream part 36 does not contact with the top surface of the holder body 21*b* or the cleaning blade 23 during the movement of the transport member 31.

Each vertical frame 37 is configured such that its width in the up-down direction is increased from the rear side, which is the upstream side, to the front side, which is the downstream side, in the developer transport direction Ya along the holder body 21*b*. Further, multiple vertical frames 37 are arranged to be spaced apart from each other in the widthwise direction of the recording sheet S.

Figure 4:
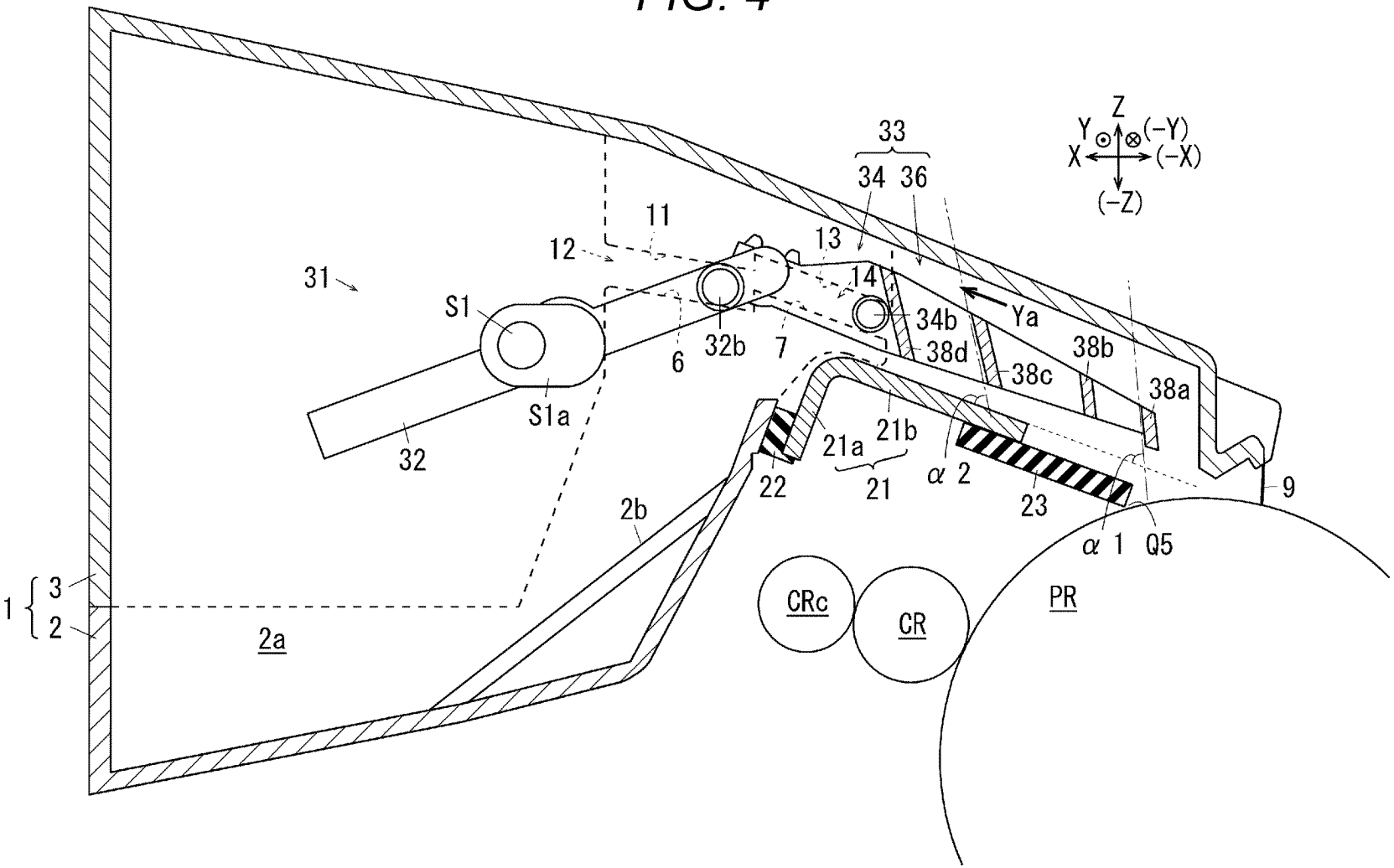
FIG. 4 is an explanatory view of an inclination angle of a horizontal frame of exemplary embodiment 1.

FIG. 4 is a view for describing the inclination angle of the horizontal frame of exemplary embodiment 1.

In FIGS. 2 to 4, the horizontal frames 38 are formed each to connect respective vertical frames 37 to each other in the left-right direction. Four horizontal frames 38 are arranged to be spaced apart from each other in the developer transport direction Ya. That is, in FIG. 4, the horizontal frames 38 in exemplary embodiment 1 include a first horizontal frame 38*a*, a second horizontal frame 38*b*, a third horizontal frame 38*c*, and a fourth horizontal frame 38*d*, which are arranged in this order from the upstream side of the developer transport direction Ya.

In FIG. 4, in exemplary embodiment 1, the front surface of each of the horizontal frames 38*a* to 38*d* is inclined to come near to the holder body 21*b* or the cleaning blade 23 toward the upstream side in the developer transport direction Ya. The front surfaces of the first horizontal frame 38*a* and the second horizontal frame 38*b* disposed to correspond to the position of the cleaning blade 23 are set such that an inclination angle $\alpha 1$ thereof relative to the developer transport direction Ya is larger than an inclination angle $\alpha 2$ of the front surfaces of the third horizontal frame 38*c* and the fourth horizontal frame 38*d* disposed to correspond to the holder body 21*b*. That is, the following relationship is satisfied: $\alpha 1 > \alpha 2$.

(Function of Photoreceptor Cleaner)

FIGS. 5A to 5D are views for describing an operation of the transport member of exemplary embodiment 1, in which FIG. 5A is a view for describing a state that is the same as FIG. 2, FIG. 5B is view for describing a state in which the transport member is rotated about the rotating shaft by 30° from the state of FIG. 5A, FIG. 5C is a view for describing a state in which the transport member is rotated about the rotating shaft by 30° from the state of FIG. 5B, and FIG. 5D is a view for describing a state in which the transport member is rotated about the rotating shaft by 30° from the state of FIG. 5C.

Figure 6A:
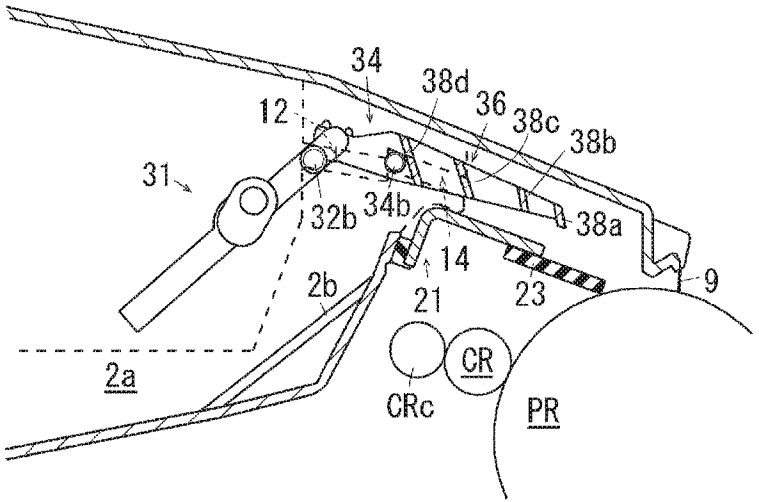
Figure 6B:
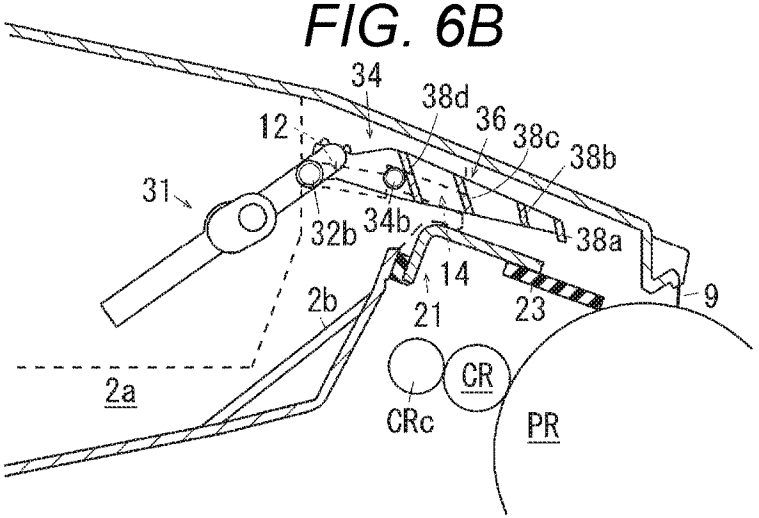
Figure 6C:
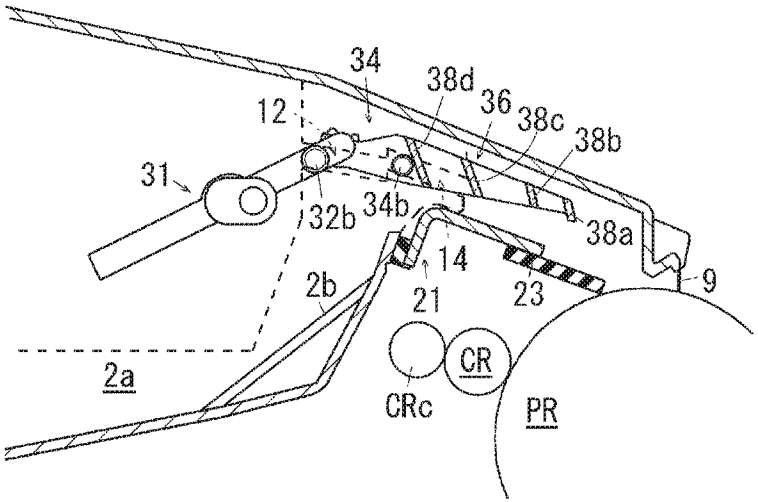
Figure 6D:
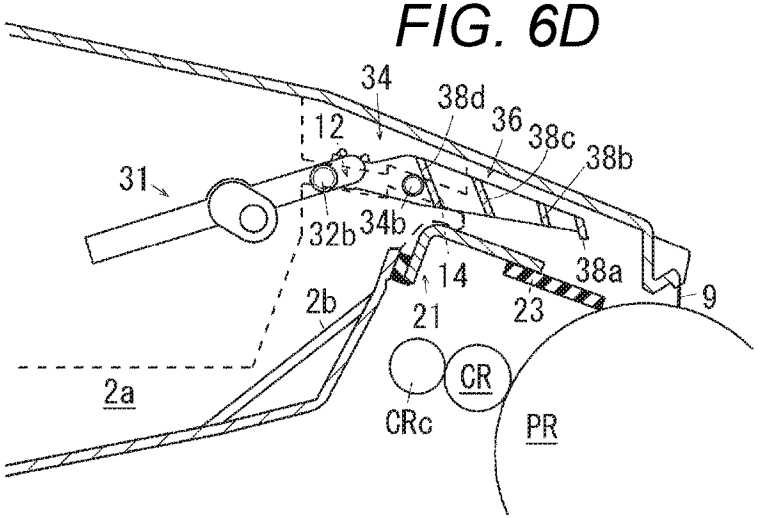

FIGS. 6A to 6D are views for describing an operation of the transport member of exemplary embodiment 1, in which FIG. 6A is a view for describing a state in which the transport member is rotated about the rotating shaft by 30° from the state of FIG. 5D, FIG. 6B is a view for describing a state in which the transport member is rotated about the rotating shaft by 30° from the state of FIG. 6A, FIG. 6C is a view for describing a state where the transport member is rotated about the rotating shaft by 30° from the state of FIG. 6B, and FIG. 6D is a view for describing a state in which the transport member is rotated about the rotating shaft by 30° from the state of FIG. 6C.

Figure 7A:
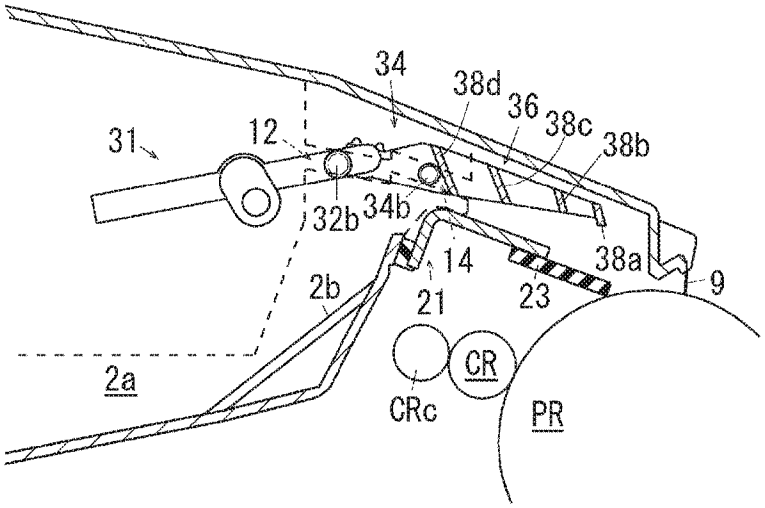
Figure 7B:
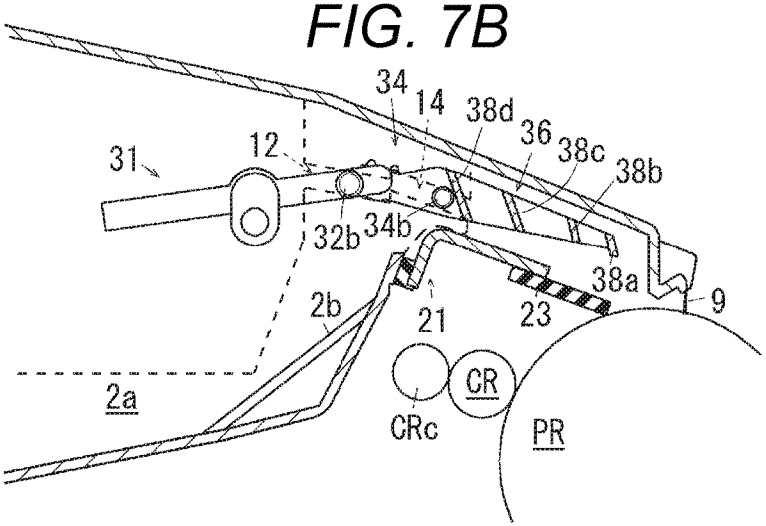
Figure 7C:
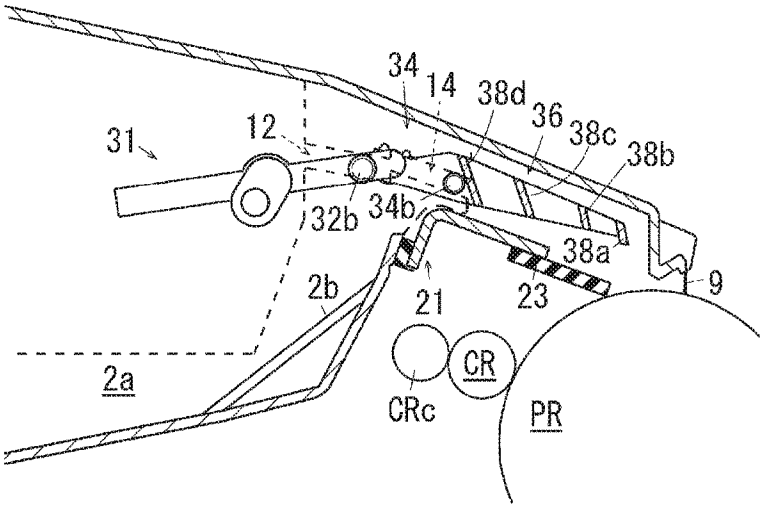
Figure 7D:
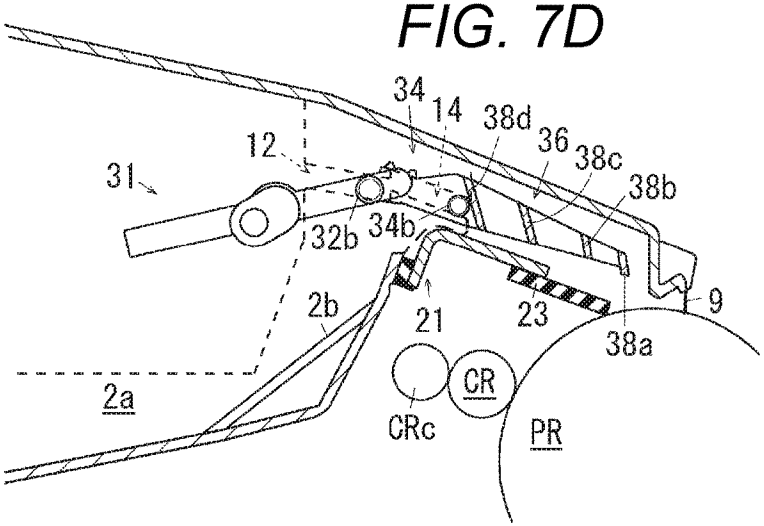

FIGS. 7A to 7D are views for describing an operation of the transport member of exemplary embodiment 1, in which FIG. 7A is a view for describing a state in which the transport member is rotated about the rotating shaft by 30° from the state of FIG. 6D, FIG. 7B is a view for describing a state in which the transport member is rotated about the rotating shaft by 30° from the state of FIG. 7A, FIG. 7C is a view for describing a state in which the transport member is rotated about the rotating shaft by 30° from the state of FIG. 7B, and FIG. 7D is a view for describing a state in which the transport member is rotated about the rotating shaft by 30° from the state of FIG. 7C.

In the printer U of exemplary embodiment 1 configured as described above, when the image forming operation is initiated, the motor is driven to rotate the rotating shaft S1. The agitating unit 32 is connected with the rotating shaft S1 via the connecting member S1*a*, and is supported in the first guide groove 12 by the first guide protrusion 32*b*. Therefore, when the rotating shaft S1 rotates, as illustrated in FIGS. 5A to 5D, FIGS. 6A to 6D, and FIGS. 7A to 7D, the front end reciprocates along a substantially elliptical trace that passes through an upper position at the right side and a lower position at the left side.

Thus, after the first horizontal frame 38*a* that is the leading end of the transport unit 33 moves to the downstream side along the developer transport direction Ya as illustrated in FIGS. 5A to 5D, then moves to the upstream side that is in a direction opposite to the developer transport direction Ya while moving upward as illustrated in FIGS. 6A to 6D, and then moves to the lower position at the right side as illustrated in FIGS. 7A to 7D. Therefore, the leading end of the transport unit 33 likewise reciprocates along a substantially elliptical trace.

Therefore, in the photoreceptor cleaner CL of exemplary embodiment 1, when the transport unit 33 is in the state illustrated in FIGS. 5A to 5D, the developer, which is pushed to the front surface of the first horizontal frame 38*a* and then recovered from the photoreceptor PR with the cleaning blade 23, is transported toward the accommodating portion 2*a*. Further, in the state illustrated in FIGS. 6A to 6D, the first horizontal frame 38*a* moves to the upstream side in the developer transport direction Ya while moving away from the cleaning blade 23 or the holder body 21*b*. Therefore, the transportation of the developer, which is transported to the downstream side in FIGS. 5A to 5D, in the reverse flow direction is reduced, compared to the case where the first horizontal frame 38*a* does not move away from the cleaning blade 23. Then, as illustrated in FIGS. 7A to 7D, the first horizontal frame 38*a* moves to the vicinity of the cleaning region Q5 and returns to the state illustrated in FIG. 5A. Therefore, in the photoreceptor cleaner CL of exemplary embodiment 1, the developer recovered to the cleaning blade 23 is transported to the accommodating portion 2*a* by the transport member 31. When the developer transported to the accommodating portion 2*a* is accumulated, the developer is agitated by the reciprocating agitating unit 32 to be leveled. In particular, in exemplary embodiment 1, the agitating unit 32 reciprocates along an elliptical trace that is relatively long in the vertical direction. Thus, it is easy to push the developer downward to stir the developer while compressing the developer. Therefore, the recovered developer is easily compressed, and it is possible to increase a recoverable amount of the developer, compared to a case where the developer is not compressed.

Here, in the photoreceptor cleaner CL of exemplary embodiment 1, the horizontal frames 38*a* to 38*d* have surfaces (top and bottom surfaces) inclined relative to the upper surface of the holder body 21*b* toward the upstream side in the developer transport direction Ya. Therefore, as illustrated in FIGS. 5A to 5D, when the horizontal frames 38*a* to 38*d* move from the upstream side toward the downstream side in the developer transport direction Ya, the developer on the top surface of the holder body 21*b* or the cleaning blade 23 is subjected to a force in a direction where it is compressed against the top surface of the holder body 21*b* or the like. In a configuration where the reciprocating motion is performed only in the developer transport direction in a state where a gap being formed between a lower surface of the transport path and the transport member like the configuration described in Patent Document 1 (JP 2009-145661A), there is a problem in that the developer in the gap is not transported. When the developer stays in the gap without being transported, the developer is fixed thereto with time, thereby becomes the transport resistance of the developer. As the transport resistance increases, the reciprocating motion of the transport member is inhibited such that transport failure may be caused.

In contrast, in exemplary embodiment 1, a force of compressing the developer acts on the top surface of the holder body 21*b* or the like, which is the bottom surface of the transport path. Therefore, when the transport unit 33 is moved in the developer transport direction Ya in the state where the compressing force is exerted, not only the developer that directly contacts with the horizontal frames 38*a* to 38*d*, but also the developer pushed by the developer that directly contacts with the horizontal frames 38*a* to 38*b* to be present between the transport unit 33 and the top surface of the holder body 21*b* is easily transported in the developer transport direction Ya. Thus, the transport efficiency (recovery efficiency) of developer is improved, compared to the technique described in Patent Document 1. Therefore, the stay of the developer is reduced and the developer transport failure is also reduced.

Further, in exemplary embodiment 1, when the developer is compressed against the holder body 21*b* or the like, the developer is compressed to be decreased in volume. Therefore, in the transport member 31 of exemplary embodiment 1, the developer is prone to be solidified. In the configuration described in Patent Document 1, a powdered developer flows from top and bottom, and left and right so that the developer transport efficiency is deteriorated. However, as in exemplary embodiment 1, a solidified developer may be easily transported by being pushed by the horizontal frame 38. Therefore, the developer transport efficiency is enhanced.

Further, with a configuration in which the transport member is made by interweaving wires in a lattice form as the configuration described in Patent Document 2 (JP 2011-149981A), it is very difficult to apply a force compressing the developer against the bottom surface of the transport path.

In addition, in exemplary embodiment 1, the inclination angle $\alpha$1 of the horizontal frames 38*a* and 38*b* corresponding to the cleaning blade 23 is larger than the inclination angle $\alpha$2 of the horizontal frames 38*c* and 38*d* corresponding to the holder body 21*b*. When the inclination angle $\alpha$1 is smaller, the force pressing the developer against the cleaning blade 23 or the holder body 21*b* is strengthened. When an external force is applied to the cleaning blade 23 made of an elastic material, a pressure value or a pressure distribution in a widthwise direction in the cleaning region Q5 may be negatively affected. That is, cleaning efficiency may be lowered to cause cleaning failure. In contrast, when comparing exemplary embodiment 1 with a case where the inclination angle $\alpha$1 of the horizontal frames 38*a* and 38*b* corresponding to the cleaning blade 23 is equal to the inclination angle $\alpha$2 of the horizontal frames 38*c* and 38*d* corresponding to the holder body 21*b*, adverse effect on the cleaning blade 23 is reduced. Therefore, the occurrence of poor cleaning is reduced.

In exemplary embodiment 1, the transport member 31 is provided with the horizontal frames 38 in the upstream part 36, but is not provided with a horizontal frame in the downstream part 34. Therefore, the downstream part 34 is inferior to the upstream part 36 in terms of the capacity of transporting the developer to the downstream side in the transport direction Ya.

The transport member 31 of exemplary embodiment 1 moves in a direction opposite to the transport direction Ya when the trace of the reciprocating movement shifts from the state illustrated in FIG. 6A to the state illustrated in FIGS. 6B, 6C and 6D to the state illustrated in FIG. 7A. Here, when the amount of the recovered developer is increased in a case where the transporting force of the upstream part is equal to that of the downstream part, some of the developer may flow reversely when the transport member moves in the reverse flow direction (−Ya). When some of the developer flows reversely, the developer is not transported to the downstream side, thereby causing a situation in which some of the developer stays. Therefore, the situation in which the developer stays is accumulated toward the downstream side in the developer transport direction Ya. Thus, the developer may be aggregated by a force transporting the developer to the upstream side from the downstream side in the developer transport direction Ya, and a force pressing the developer in the reverse flow direction. When the developer is aggregated at a midway position of the transport member, the transport member may be clogged with the developer, thereby causing the transport failure of developer.

In contrast, in exemplary embodiment 1, a transporting force of the downstream part 34 is lower than that of the upstream part 36. Therefore, the force applied to the developer in the reverse flow direction is smaller than the force applied in the transport direction Ya. Therefore, when comparing exemplary embodiment 1 with the case where the transporting force of the upstream part is equal to that of the downstream part, exemplary embodiment 1 reduces the aggregation of the developer. Therefore, the transport failure of the developer is reduced.

Particularly, when the transport member 31 of exemplary embodiment 1 moves in the reverse flow direction (the direction −Ya), the transport member moves in the reverse flow direction (the direction −Ya) while moving upward. Such a configuration further reduces the reverse flow compared to a configuration where the transport member does not move upward.

Further, in exemplary embodiment 1, the transporting force of the developer of the downstream part 34 is zero. Thus, the force applied to the developer in the reverse flow direction is zero. Therefore, the aggregation of the developer is further reduced, compared to the case where the downstream part 34 has the transporting force. Further, the developer transported to a range of the downstream part 34 is transported to the downstream side by being pushed by the developer sent from the upstream by the upstream part 36.

In exemplary embodiment 1, as illustrated in FIGS. 5 to 7, the downstream end of the downstream part 34 is located downstream of the upstream end of the inclined surface 2*b* of the container body 2. In particular, in exemplary embodiment 1, the downstream part 34 is disposed to be located over the upstream end of the inclined surface 2*b* of the container body 2. Thus, the downstream part 34 is disposed to be located over the upstream end of the inclined surface 2*b* in the transport direction Ya.

Thus, when the developer transported to the range of the downstream part 34 reaches the upstream end of the inclined surface 2*b*, the developer drops toward the inclined surface 2*b* by gravity. Therefore, the clogging with the developer in the range of the downstream part 34 is reduced.

In exemplary embodiment 1, the agitating unit 32 and the transport unit 33 of the transport member 31 are rotatably connected to each other. With a configuration provided with a plate-shaped transport member as in the configuration described in Patent Documents 1 and 2, the length of the transport member is increased in the transport direction, and thus, it is difficult to reduce the entire size of the photoreceptor cleaner CL. In contrast, in exemplary embodiment 1, the agitating unit 32 and the transport unit 33 are rotatably connected and supported in a bent state. Therefore, the entire length of the transport member 31 may be reduce, compared to the configuration described in Patent Documents 1 and 2, and thus, the miniaturization of the photoreceptor cleaner CL may be realized.

MODIFICATION EXAMPLE

In the foregoing, the exemplary embodiment of the present invention have been described in detail. However, the present invention is not limited to the exemplary embodiment and various modifications may be made within the scope of the present invention defined in the accompanying claims. Modification examples (H01) to (H06) of the present invention will be exemplified below.

(H01) In the above-mentioned exemplary embodiment, a printer U is exemplified as an example of an image forming apparatus. However, without being limited to the printer, for example, the image forming apparatus may be constituted by a copier, a facsimile, a composite machine having multiple and all functions thereof, or the like.

(H02) In the above-mentioned exemplary embodiment, the printer U configured to use the developer of a single color is exemplified. However, without being limited thereto, the invention may also be applied to, for example, an image forming apparatus for forming an image of two or more colors.

(H03) In the above-mentioned exemplary embodiment, the inclination angles $\alpha 1$ and $\alpha 2$ of the horizontal frame 38 are preferably set to $\alpha 1 > \alpha 2$ as exemplified in the exemplary embodiment, but are not limited thereto. For example, the inclination angles may be set to $\alpha 1 = \alpha 2$. Further, as for the four horizontal frames 38*a* to 38*d*, their inclination angles may be set to be increased toward the downstream side. The number of the horizontal frames 38*a* to 38*d* may be three (3) or less or five or more without being limited to four (4). The vertical frames 37 are preferably provided to secure strength, but may not be provided.

(H04) In the above-mentioned exemplary embodiment, a configuration is exemplified where the downstream part 34 of the transport member 31 does not have a transporting capacity, but is not limited thereto. However, the downstream part may be configured to have a transporting capacity lower than that of the upstream part 36. For example, the downstream part 34 may be provided with horizontal frames having an interval larger than that in the upstream part 36 may be provided in the downstream part 34, or may be provided with horizontal frames lower than those of the upstream part.

(H05) In the above-mentioned exemplary embodiment, the downstream end of the downstream part 34 is preferably located downstream of the upstream end of the inclined surface 2*b*. However, the downstream end of the downstream part 34 may be located upstream of the upstream end of the inclined surface 2*b*.

(H06) In the above-mentioned exemplary embodiment, the transporting capacity of the downstream part 34 is preferably lower than the transporting capacity of the upstream part 36. However, the upstream part 36 and the downstream part 34 may be configured to have the same transporting capacity.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning unit comprising:

a cleaning member that removes developer from a surface of an image holding member;

an accommodating portion that accommodates the removed developer;

a supporting body that supports the cleaning member and is disposed along a transport path of the removed developer between the cleaning member and the accommodating portion; and a transport member that transports the developer removed by the cleaning member to the accommodating portion, the transport member comprising a plurality of transport frames configured to transport the removed developer while contacting with the removed developer, the plurality of transport frames including a first transport frame extending in a direction intersecting with the cleaning member and having a first surface that faces the cleaning member and that is inclined relative to the supporting body in an upstream direction of the transported developer when the transport member is positioned at a nearest position to the cleaning member, and a second transport frame extending in a direction intersecting with the supporting body and having a second surface that faces the supporting body and that is inclined relative to the supporting body in the upstream direction of the transported developer when the transport member is positioned at the nearest position to the cleaning member.

2. The cleaning unit according to claim 1, wherein a first inclination angle of the first surface relative to the supporting body is larger than a second inclination angle of the second surface relative to the supporting body.

3. An image forming apparatus comprising:

the image holding member;

a latent image forming device that forms a latent image on the image holding member;

a developing device that develops the latent image of the image holding member as a visible image;

a transfer device that transfers the visible image on the image holding member to a medium; and the cleaning unit of claim 1 that removes the developer from the surface of the image holding member after transfer.

* * * * *